US010314125B2

(12) United States Patent
Grajcar et al.

(10) Patent No.: US 10,314,125 B2
(45) Date of Patent: Jun. 4, 2019

(54) DIMMABLE ANALOG AC CIRCUIT

(71) Applicant: Once, Inc., Plymouth, MN (US)

(72) Inventors: Zdenko Grajcar, Orono, MN (US); David Natarelli, Victor, NY (US); Hoa Huynh, St. Paul, MN (US)

(73) Assignee: Once Innovations, Inc., Plymouth, MN (US)

( * ) Notice: Subject to any disclaimer, the term of this patent is extended or adjusted under 35 U.S.C. 154(b) by 0 days.

(21) Appl. No.: 15/680,980

(22) Filed: Aug. 18, 2017

(65) Prior Publication Data

US 2018/0098392 A1 Apr. 5, 2018

Related U.S. Application Data

(60) Provisional application No. 62/402,631, filed on Sep. 30, 2016.

(51) Int. Cl.
*H05B 37/02* (2006.01)
*H05B 33/08* (2006.01)

(52) U.S. Cl.
CPC ..... *H05B 33/083* (2013.01); *H05B 33/0815* (2013.01); *H05B 33/0845* (2013.01); *H05B 33/0857* (2013.01)

(58) Field of Classification Search
CPC ..... H05B 33/0812; H05B 33/0815; H05B 33/0827; H05B 33/0833; H05B 33/0845
USPC ..... 315/192, 193, 294
See application file for complete search history.

(56) References Cited

U.S. PATENT DOCUMENTS

| | | | |
|---|---|---|---|
| 6,933,707 | B2 | 8/2005 | Allen |
| 7,038,399 | B2 | 5/2006 | Lys et al. |
| 7,081,722 | B1 | 7/2006 | Huynh et al. |
| 7,102,334 | B2 | 9/2006 | Wiegand et al. |
| 7,102,344 | B1 | 9/2006 | Short |
| 7,131,397 | B2 | 11/2006 | El Halawani et al. |
| 7,213,942 | B2 | 5/2007 | Jiang et al. |
| 7,288,902 | B1 | 10/2007 | Melanson |
| 7,352,138 | B2 | 4/2008 | Lys et al. |
| 7,358,679 | B2 | 4/2008 | Lys et al. |

(Continued)

FOREIGN PATENT DOCUMENTS

| | | |
|---|---|---|
| CN | 101162847 | 4/2008 |
| CN | 102612791 | 7/2012 |

(Continued)

OTHER PUBLICATIONS

"Hazards of Harmonics and Neutral Overloads", White Paper #26, 2003, pp. 1-8, American Power Conversion.

(Continued)

*Primary Examiner* — Tung X Le

(57) ABSTRACT

An analog AC driven fully dimmable circuit that reduces the gap between peak current and a minimum current to improve dimming properties and provide additional functionality to a lighting device. The circuit provides ancillary circuitry that bypasses an analog step driving section of the circuit without the use of an ancillary transistor. The ancillary circuitry bypasses the analog step driving section of the circuit and has a capacitor to continuously provide current to the first series interconnection such that the first series interconnection continuously emits light during operation of the circuit.

8 Claims, 3 Drawing Sheets

(56) References Cited

U.S. PATENT DOCUMENTS

| | | | | |
|---|---|---|---|---|
| 7,378,805 | B2 | 5/2008 | Oh et al. | |
| 7,391,630 | B2 | 6/2008 | Acatrinei | |
| 7,425,801 | B2 | 9/2008 | Ozaki | |
| 7,489,086 | B2 | 2/2009 | Miskin et al. | |
| 7,709,774 | B2 | 5/2010 | Schulz et al. | |
| 7,737,643 | B2 | 6/2010 | Lys | |
| 7,781,979 | B2 | 8/2010 | Lys | |
| 7,791,289 | B2 | 9/2010 | Oosterbaan et al. | |
| 7,847,486 | B2 | 12/2010 | Ng | |
| 7,847,496 | B2 | 12/2010 | Bui et al. | |
| 7,859,196 | B2 | 12/2010 | Lee et al. | |
| 7,863,831 | B2 | 1/2011 | Vos | |
| 7,880,400 | B2 | 2/2011 | Zhou et al. | |
| 7,902,769 | B2 | 3/2011 | Shteynberg et al. | |
| 7,936,135 | B2 | 5/2011 | Hum et al. | |
| 7,977,892 | B2 | 7/2011 | Lee et al. | |
| 8,102,167 | B2 | 1/2012 | Irissou et al. | |
| 8,120,279 | B2 | 2/2012 | Oosterbaan et al. | |
| 8,134,303 | B2 | 3/2012 | Lys | |
| 8,159,125 | B2 | 4/2012 | Miao | |
| 8,164,276 | B2 | 4/2012 | Kuwabara | |
| 8,188,679 | B2 | 5/2012 | Hoogzaad | |
| 8,188,687 | B2 | 5/2012 | Lee et al. | |
| 8,324,642 | B2 | 12/2012 | Grajcar | |
| 8,324,840 | B2 | 12/2012 | Shteynberg et al. | |
| 8,373,363 | B2 | 2/2013 | Grajcar | |
| 8,384,307 | B2 | 2/2013 | Grajcar | |
| 8,531,136 | B2 | 9/2013 | Grajcar | |
| 8,593,044 | B2 | 11/2013 | Grajcar | |
| 8,596,804 | B2 | 12/2013 | Grajcar | |
| 8,598,799 | B2 | 12/2013 | Tai et al. | |
| 8,643,308 | B2 | 2/2014 | Grajcar | |
| 8,736,194 | B2 | 5/2014 | Kawai et al. | |
| 8,773,031 | B2 | 7/2014 | Sadwick et al. | |
| 8,796,955 | B2 | 8/2014 | Grajcar | |
| 8,907,576 | B2 | 12/2014 | Ferrier | |
| 8,922,136 | B2 | 12/2014 | Grajcar | |
| 9,155,151 | B2 | 10/2015 | Angeles | |
| 9,210,755 | B2 | 12/2015 | Grajcar et al. | |
| 9,247,603 | B2 | 1/2016 | Grajcar | |
| 9,374,858 | B2 | 6/2016 | Ni | |
| 9,380,665 | B2 | 6/2016 | Grajcar et al. | |
| 9,433,046 | B2 | 8/2016 | Grajcar | |
| 9,775,209 | B2 * | 9/2017 | Grajcar | H05B 33/0845 |
| 2002/0047606 | A1 | 4/2002 | Guthrie et al. | |
| 2002/0097007 | A1 | 7/2002 | Koncz et al. | |
| 2002/0149929 | A1 | 10/2002 | Evans et al. | |
| 2003/0164809 | A1 | 9/2003 | Leung | |
| 2005/0212458 | A1 | 9/2005 | Powers, Jr. et al. | |
| 2005/0256554 | A1 | 11/2005 | Malak | |
| 2005/0280964 | A1 | 12/2005 | Richmond et al. | |
| 2006/0214603 | A1 | 9/2006 | Oh et al. | |
| 2007/0086912 | A1 | 4/2007 | Dowling et al. | |
| 2007/0182338 | A1 | 8/2007 | Shteynberg et al. | |
| 2007/0258240 | A1 | 11/2007 | Ducharme et al. | |
| 2008/0012722 | A1 | 1/2008 | Moseley et al. | |
| 2008/0042588 | A1 | 2/2008 | Chan et al. | |
| 2008/0116816 | A1 | 5/2008 | Neuman et al. | |
| 2008/0174233 | A1 | 7/2008 | Bawendi et al. | |
| 2008/0203936 | A1 | 8/2008 | Mariyama et al. | |
| 2008/0211421 | A1 | 9/2008 | Lee et al. | |
| 2009/0096739 | A1 | 4/2009 | Lan et al. | |
| 2009/0160370 | A1 | 6/2009 | Tai et al. | |
| 2009/0185373 | A1 | 7/2009 | Grajcar | |
| 2009/0262515 | A1 | 10/2009 | Lee | |
| 2009/0267534 | A1 | 10/2009 | Godbole et al. | |
| 2010/0013402 | A1 | 1/2010 | Chaffai et al. | |
| 2010/0060175 | A1 | 3/2010 | Lethellier | |
| 2010/0072903 | A1 | 3/2010 | Blaut et al. | |
| 2010/0164579 | A1 | 7/2010 | Acatrinei | |
| 2010/0165677 | A1 | 7/2010 | Wang et al. | |
| 2010/0225241 | A1 | 9/2010 | Maehara et al. | |
| 2010/0237800 | A1 | 9/2010 | Kang et al. | |
| 2010/0294205 | A1 | 11/2010 | Kakimi et al. | |
| 2010/0308739 | A1 | 12/2010 | Shteynberg et al. | |
| 2010/0308751 | A1 | 12/2010 | Nerone | |
| 2011/0018465 | A1 | 1/2011 | Ashdown | |
| 2011/0031890 | A1 | 2/2011 | Stack et al. | |
| 2011/0037415 | A1 | 2/2011 | Juestel et al. | |
| 2011/0084619 | A1 | 4/2011 | Gray et al. | |
| 2011/0101883 | A1 | 5/2011 | Grajcar | |
| 2011/0109244 | A1 | 5/2011 | Grajcar | |
| 2011/0163680 | A1 | 7/2011 | Welten | |
| 2011/0210678 | A1 | 9/2011 | Grajcar | |
| 2011/0227490 | A1 | 9/2011 | Huynh | |
| 2011/0228515 | A1 | 9/2011 | Grajcar | |
| 2011/0273103 | A1 | 11/2011 | Hong | |
| 2012/0001558 | A1 | 1/2012 | Vos | |
| 2012/0002408 | A1 | 1/2012 | Lichten et al. | |
| 2012/0025709 | A1 | 2/2012 | Zampini et al. | |
| 2012/0081009 | A1 | 4/2012 | Shteynberg et al. | |
| 2012/0081018 | A1 | 4/2012 | Shteynberg et al. | |
| 2012/0153833 | A1 | 6/2012 | Mikani et al. | |
| 2012/0200229 | A1 | 8/2012 | Kunst et al. | |
| 2012/0223649 | A1 | 9/2012 | Saes et al. | |
| 2012/0268918 | A1 | 10/2012 | Grajcar | |
| 2012/0299500 | A1 | 11/2012 | Sadwick et al. | |
| 2013/0069536 | A1 | 3/2013 | Ni | |
| 2013/0069546 | A1 | 3/2013 | Lin et al. | |
| 2013/0127356 | A1 | 5/2013 | Tanaka et al. | |
| 2013/0134888 | A1 | 5/2013 | Grajcar | |
| 2013/0153938 | A1 | 6/2013 | Grajcar | |
| 2013/0157394 | A1 | 6/2013 | Grajcar | |
| 2013/0162153 | A1 * | 6/2013 | van de Ven | H05B 33/083 315/193 |
| 2013/0169159 | A1 | 7/2013 | Lys | |
| 2013/0187572 | A1 | 7/2013 | Grajcar | |
| 2013/0193864 | A1 | 8/2013 | Angeles | |
| 2013/0200812 | A1 | 8/2013 | Radermacher et al. | |
| 2013/0207555 | A1 | 8/2013 | Qiu et al. | |
| 2013/0234622 | A1 | 9/2013 | Tanaka et al. | |
| 2013/0342120 | A1 | 12/2013 | Creusen et al. | |
| 2014/0098531 | A1 | 4/2014 | Grajcar | |
| 2014/0103823 | A1 | 4/2014 | Kahman et al. | |
| 2014/0111091 | A1 | 4/2014 | Grajcar et al. | |
| 2014/0159584 | A1 | 6/2014 | Grajcar | |
| 2014/0197741 | A1 * | 7/2014 | Sakai | H05B 33/0824 315/123 |
| 2014/0197751 | A1 | 7/2014 | Grajcar | |
| 2014/0210352 | A1 | 7/2014 | Grajcar | |
| 2014/0210357 | A1 * | 7/2014 | Yan | H05B 33/0824 315/186 |
| 2014/0361695 | A1 * | 12/2014 | Akiyama | H05B 33/0812 315/185 R |
| 2015/0061534 | A1 | 3/2015 | Grajcar | |
| 2015/0069932 | A1 | 3/2015 | Grajcar | |
| 2015/0230309 | A1 | 8/2015 | Grajcar et al. | |
| 2015/0237696 | A1 | 8/2015 | Shackle | |
| 2016/0113079 | A1 | 4/2016 | Hiramatu | |
| 2016/0135258 | A1 * | 5/2016 | Wang | H05B 33/0845 315/200 R |
| 2016/0323960 | A1 | 11/2016 | Grajcar | |
| 2017/0064781 | A1 * | 3/2017 | Haskvitz | H05B 33/083 |
| 2017/0156186 | A1 * | 6/2017 | Grajcar | H05B 33/0845 |

FOREIGN PATENT DOCUMENTS

| | | |
|---|---|---|
| CN | 104106122 | 10/2014 |
| EP | 1502483 | 2/2005 |
| EP | 2094063 | 8/2009 |
| EP | 2465174 | 2/2011 |
| EP | 2465329 | 6/2012 |
| EP | 2666220 | 11/2013 |
| EP | 2795654 | 10/2014 |
| JP | 2004248333 | 9/2004 |
| JP | 2006147933 | 6/2006 |
| JP | 2006244848 | 9/2006 |
| JP | 2007511903 | 5/2007 |
| JP | 2007299788 | 11/2007 |
| JP | 2008218043 | 9/2008 |
| JP | 2009117036 | 5/2009 |
| JP | 2009123427 | 6/2009 |
| JP | 2011040701 | 2/2011 |

(56) References Cited

FOREIGN PATENT DOCUMENTS

| | | |
|---|---|---|
| JP | 2014516452 | 7/2014 |
| JP | 5676611 | 1/2015 |
| KR | 20120112146 | 10/2012 |

OTHER PUBLICATIONS

Dartnall, H. J.A, et al., "Human Visual Pigments: Microspectrophotometric Results from the Eyes of Seven Persons", Proceedings of the Royal Society of London. Series B, Biological Sciences 220(1218), (Nov. 22, 1983), 115-130.
Kennedy, et al. "Selective Light Absorption by the Lenses of Lower Vertebrates, and its Influence on Spectral Sensitivity", The Biological Bulletin 111:375-386 Dec. 1956.
Halevy, O., et al., "Muscle development—Could environmental manipulations during embryogenesis of broilers change it?", EPC 2006—12th European Poultry Conference, (Sep. 2006), 7 pgs.
Rahimi, G., et al., "The Effect of Intermittent Lighting Schedule on Broiler Performance", International Journal of Poultry Science, 4(6), (2005), 396-398.
Rozenboim, I., et al., "The effect of a green and blue monochromatic light combination on broiler growth and development", Poultry Science, 83(5), (2004), 842-845.
Rozenboim, I., et al., "The Effect of Monochromatic Light on Broiler Growth and Development", Poultry Science, 78(1), (1999), 135-138.
Taylor, Todd, "Great Green Hope: The Corporate Love Affair With Algae", Biomass Magazine, (Apr. 2010), 2 pgs.
"Sequential Linear LED Driver, CL8800", Supertex inc., Sunnyvale, California, 2012.
"TPS92411x Floating Switch for Offline AC Linear Direct Drive of LEDs with Low Ripple Current", Texas Instruments, Oct. 2013.

* cited by examiner

DIMMABLE ANALOG AC CIRCUIT

CROSS REFERENCE

This application is based upon and claims benefit to U.S. Provisional Patent Application Ser. No. 62/402,631 filed Sep. 30, 2017 entitled Dimmable Analog AC Circuit to Grajcar, et al. and that application is incorporated by reference in full.

BACKGROUND

This invention relates to LED lighting circuits. More specifically this invention relates to a circuit for providing improved operation of an LED lighting device.

LED lighting as an energy efficient lighting source is becoming more and more popular world-wide. Several ways exist regarding how to successfully operate and dim LED devices. In particular, typically line voltage is AC or alternating current voltage where the voltage and current are represented by a sine wave. One circuit that can be used to operate and dim LED utilizes a rectifier and AC to DC converter in association with a PWM device to provide dimming.

In an alternative embodiment applicant eliminated the AC to DC converter and need for a PWM device through conditioning the AC current directly provided to the LEDs. This is shown in applicant's U.S. Pat. No. 8,373,363 that is incorporated in full herein. While effective at operating and dimming, problems remain. During analog operation there are times during operation where current exists at zero cross for extended periods of time. For certain operations light is desired during this period. As one example, some flicker indexes put out by specification makers focus, not just on frequency of the AC sine wave, but also on the drop in current from peak to the valley of the sine wave. In another embodiment, in agricultural and horticulture applications applicant has found that low levels of green light can be beneficial to animal and plant growth and should be used in combination with other colored lighting to optimize growth in animals and plants. Thus a need exists in analog circuits to reduce the gap between peak current and the current at a valley to improve dimming properties and provide additional functionality to a lighting device.

Therefore, a principle object of the present invention is to improve dimming functionality of an AC analog circuit.

Yet another object of the present invention is to improve functionality on an AC analog circuit.

These and other object, feature and advantages will become apparent from the specification and claims.

BRIEF SUMMARY OF THE INVENTION

A circuit having a first series interconnection of a first light-emitting diode (LED) group, a first transistor, a first resistor, a second series interconnection of a second LED group, a second transistor, and a second resistor. The first series interconnection has a cathode coupled to a drain terminal of the first transistor and a source terminal of the first transistor is coupled to a first terminal of the first resistor wherein voltage across the first resistor provides a biasing voltage for the first transistor. The second series interconnection is coupled to a drain terminal of the second transistor and a first terminal of the second resistor wherein voltage across the second resistor provides a biasing voltage for the second transistor. The circuit additionally has ancillary circuitry bypassing the first series interconnection and having a capacitor to continuously provide current to the first series interconnection such that the first series interconnection continuously emits light during operation of the circuit and the capacitor is connected between the drain of the second transistor and a rectifier. By providing the continuous current functioning is improved.

DETAILED DESCRIPTION OF A PREFERRED EMBODIMENT

Figure 1:
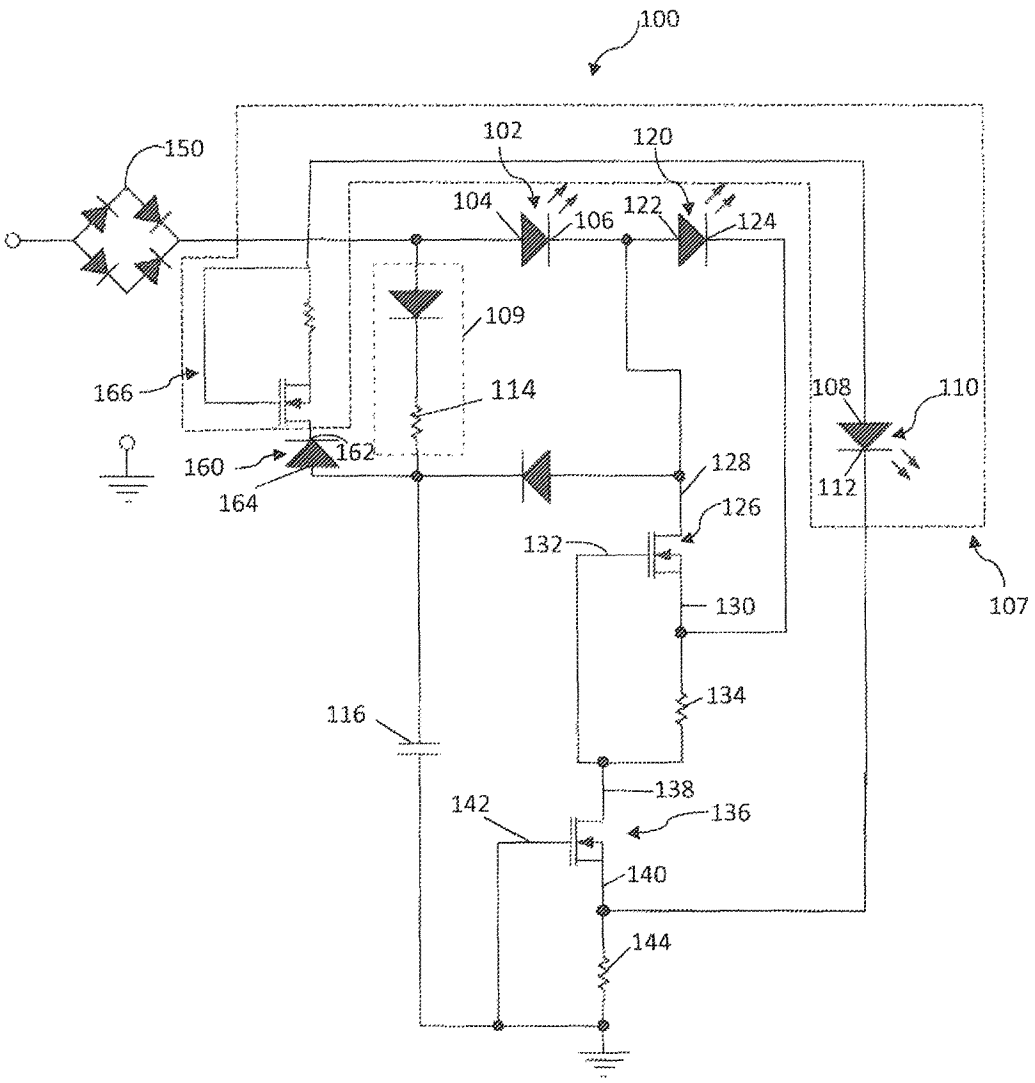
FIG. 1 is a schematic diagram of a circuit.

In the following detailed description, numerous specific details are set forth by way of examples in order to provide a thorough understanding of the relevant teachings. However, it should be apparent to those skilled in the art that the present teachings may be practiced without such details. In other instances, well known methods, procedures, components, and/or circuitry have been described at a relatively high-level, without detail, in order to avoid unnecessarily obscuring aspects of the present teachings.

Driving circuitry for powering light emitting diode (LED) lights generally rely on digital circuitry to measure the instantaneous value of a driving voltage, on a microprocessor to identify LEDs to activate based on the measured value, and on digital switches to selectively activate the identified LEDs. The digital circuitry, however, reduces the overall efficiency of the LED lighting by causing harmonic distortion and power factor distortion in the LED light and the associated power line. In order to reduce the harmonic distortion and power factor distortion caused by the digital circuitry, a current conditioning circuit is presented for selectively routing current to various LED groups in a LED light. The current conditioning circuit uses analog components and circuitry for operation, and produces minimal harmonic distortion and power factor distortion.

The current conditioning circuitry is provided to selectively route current to different LED groups depending on the instantaneous value of an AC input voltage. In a preferred embodiment, the conditioning circuitry includes only analog circuit components and does not include digital components or digital switches for operation.

The circuitry relies on depletion-mode metal-oxide-semiconductor field-effect transistor (MOSFET) transistors for operation. In a preferred embodiment, the depletion MOSFET transistors have a high resistance between their drain and source terminals, and switch between conducting and non-conducting states relatively slowly. The depletion-mode MOSFET transistors may conduct current between their drain and source terminals when a voltage $V_{GS}$ between the gate and source terminals is zero or positive and the MOSFET transistor is operating in the saturation (or active, or conducting) mode (or region, or state). The current through the depletion-mode MOSFET transistor, however, may be restricted if a negative $V_{GS}$ voltage is applied to the terminals and the MOSFET transistor enters the cutoff (or non-conducting) mode (or region, or state).

The MOSFET transistor transitions between the saturation and cutoff modes by operating in the linear or ohmic mode or region, in which the amount of current flowing through the transistor (between the drain and source terminals) is dependent on the voltage between the gate and source terminals $V_{GS}$. In one example, the depletion MOSFET transistors preferably have an elevated resistance between drain and source (when operating in the linear mode) such that the transistors switch between the saturation and cutoff modes relatively slowly. The depletion MOSFET transistors switch between the saturation and cutoff modes by operating in the linear or ohmic region, thereby providing a smooth and gradual transition between the saturation and cutoff modes. In one example, a depletion-mode MOSFET transistor may have a threshold voltage of −2.6 volts, such that the depletion-mode MOSFET transistor allows substantially no current to pass between the drain and source terminals when the gate-source voltage $V_{GS}$ is below −2.6 volts. Other values of threshold voltages may alternatively be used.

FIG. 1 is a schematic diagram showing a conditioning circuit 100 for driving three LED groups using a rectified AC input voltage. The conditioning circuit 100 uses analog circuitry to selectively route current to the LED groups based on the instantaneous value of the AC input voltage.

The conditioning circuit 100 receives an AC input voltage from an AC voltage source (not shown), such as a power supply, an AC line voltage, or the like. The AC voltage source is coupled to a fuse and rectifier (not shown) to provide a rectified AC input as is known in the art.

The conditioning circuit 100 has a first series interconnection of a first LED group 102 with an anode 104 and cathode 106. The anode 104 is in parallel connection to ancillary circuitry 107. In particular the anode 104 of the first LED group 102 is in parallel connection to an anode 108 of a valley fill LED group 110 of the ancillary circuitry 107. The ancillary circuitry 107 also includes circuit protection elements 109 that in one embodiment is a combination diode and resistor. The valley fill LED group 110 additionally has a cathode 112 in series to a resistor 144. The valley fill LED group 110 can consist of one or more LEDs connected in series. A capacitor 116 is in connection with the resistor 114 to discharge current to ensure the flow of current through the valley fill LED group 110 throughout a current cycle.

A second series interconnection of a second LED group 120 with an anode 122 and a cathode 124 is in series with the first series interconnection of the first LED group 102. Each LED group 102 and 120 can be formed of one or more LEDs, or of one or more high-voltage LEDs. In examples in which a LED group includes two or more LEDs (or two or more high-voltage LEDs), the LEDs may be coupled in series and/or in parallel.

In a bypass path, a first depletion MOSFET transistor 126 has a drain 128, source 130 and gate 132 and is in series connection to the first LED group 102 and parallel connection with the second LED group 120. The drain 128 of the first depletion MOSFET transistor 126 is electrically connected to the cathode 106 of the first LED group 102 while the source 130 is connected in series to a first sense resistor 134. In addition, the cathode 124 of the second LED group 120 is in series connection with the first sense resistor 134. The gate 132 of the first depletion MOSFET transistor 126 and the sense resistor 134 are connected in series to a second depletion MOSFET transistor 136 having a drain 138, source 140 and gate 142. Similar to the first depletion MOSFET transistor 126, the second depletion MOSFET transistor 136 has its source 140 electrically connected to a second sense resistor 144. In addition, the cathode of the valley fill LED group 110 is electrically connected in series with the second sense resistor 144 that is connected to a ground.

In operation, current flows to the first LED group 102 and the valley fill LED group 110. Upon reaching a threshold voltage of the valley fill LED group 110 current flows through the valley fill LED group 110 emitting light at a low level. Simultaneously, as the voltage increases it reaches the threshold voltage of the first LED group 102 and current begins flowing through the first LED group 102. Specifically the threshold voltage of the valley fill LED group 110 is less than the threshold voltage of the first LED group 102.

As current flows through the first LED group 102, prior to reaching a threshold voltage of the second LED group 120 current is dynamically bypassed from the second LED group to the first depletion MOSFET transistor 126 until the threshold voltage of the second LED group 120 is reached. At that point the current flows through the second LED group 120. As the voltage cycle continues and voltage falls below the threshold value of the second LED group 120, current stops flowing through the second LED group 120 and light is no longer emitted from the second LED group 120. Similarly, once the voltage falls below the threshold voltage of the first LED group 102 current stops flowing through the first LED group 102 and the first LED group 102 stops emitting light.

As the input voltage of the AC input falls below the threshold voltage of the valley fill LED group 110, the capacitor 116 discharges through ancillary transistor 166 and through diode 160 keeping the voltage at the valley fill LED group 110 above the threshold voltage of the valley fill LED group 110. As a result, the valley fill LED group 110 continues to emit light even after the first and second LED groups stop emitting light.

Figure 2:
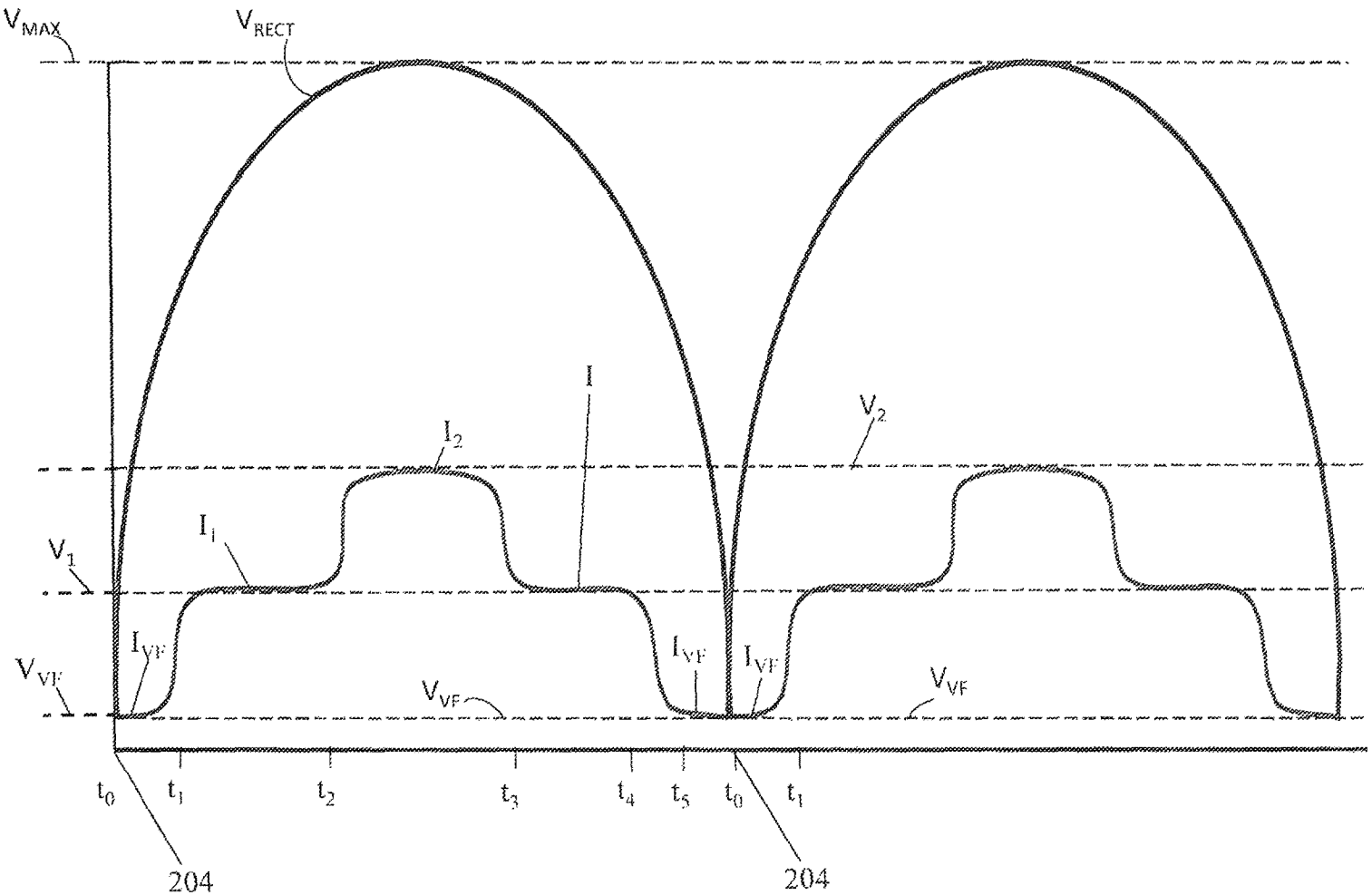
FIG. 2 is a diagram showing current and voltage over time of the circuit of FIG. 1.
Figure 3:
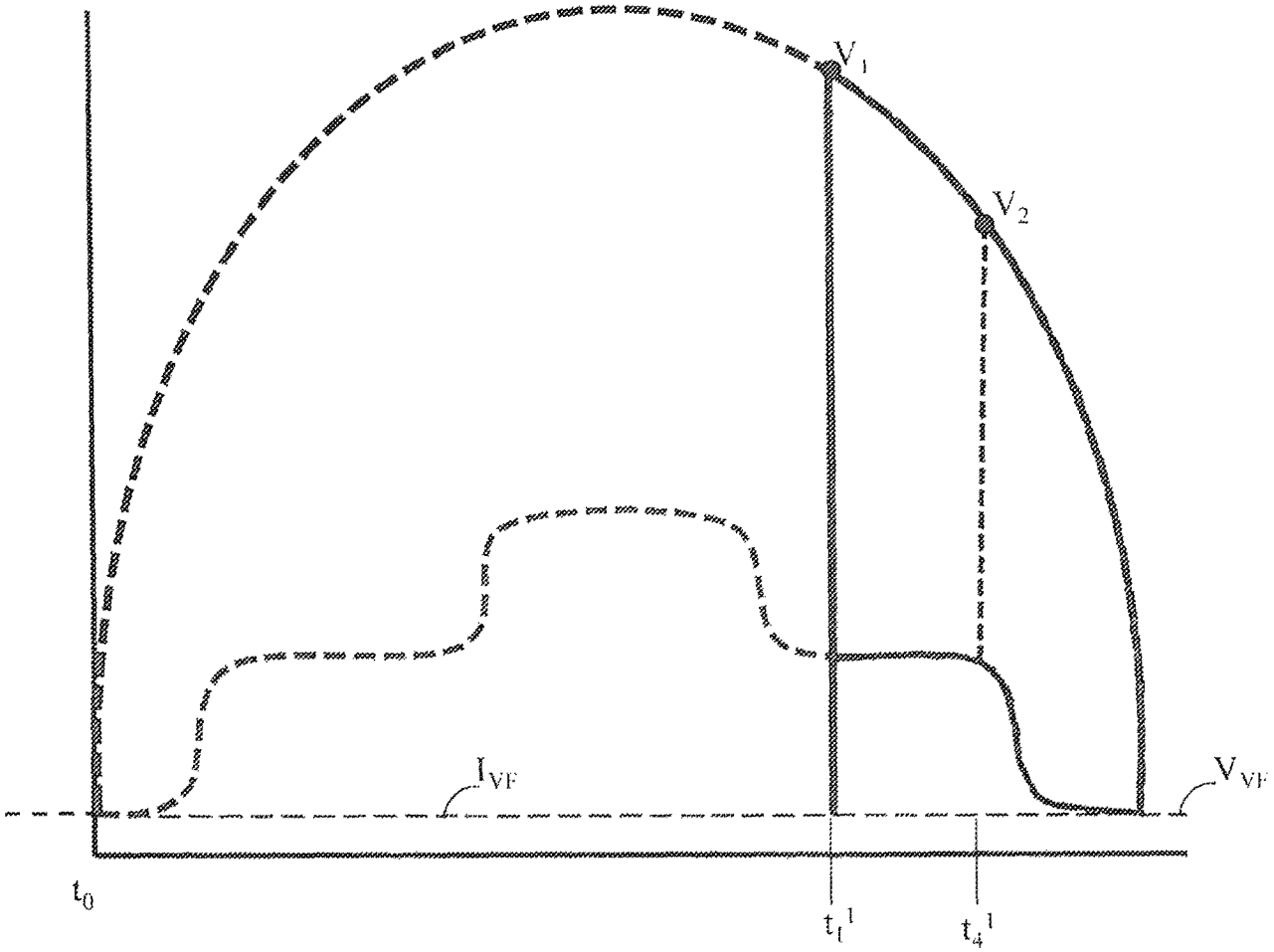
FIG. 3 is a diagram showing current and voltage over time of the circuit of FIG. 1 when the circuit is being dimmed.

In operation, in the driving circuitry 100 of FIG. 1, one or both of the LED groups 102 and 120 may conduct current depending on whether the forward voltage of one or both of the LED groups 102 and 120 is satisfied. The operation of the LED driving circuitry 100 of FIG. 1 will be explained with reference to the input voltage and circuit current timing diagrams of FIG. 2-3. FIGS. 2-3 are input voltage and circuit current timing diagrams showing the rectified input voltage $V_{rect}$ during one cycle. The rectified voltage $V_{rect}$ may be applied at the output of a voltage rectifier 150 to the LED groups 102 and 120, as shown in driving circuitry 100 of FIG. 1.

The exemplary cycle of the rectified input voltage $V_{rect}$ shown in FIG. 2 begins at time to with the rectified input voltage $V_{rect}$ having a value of 0V (0 volts). The rectified voltage $V_{rect}$ undergoes a half-sine cycle between times to back to $t_0$. Between times $t_0$ and $t_1$, the value of the rectified input voltage $V_{rect}$ remains below the forward voltage of the first LED group 102, and no current flows through the first LED group 102. During this time period, $t_0$ and $t_1$, during a sinusoidal cycle, the capacitor 116 discharges, causing current $I_{VF}$ to flow to the valley fill LED group 110 such that the voltage at the valley fill LED group 110 is above a threshold voltage $V_{VF}$ of the valley fill LED group 110 resulting in the valley fill LED group emitting light.

As the rectified voltage $V_{rect}$ reaches a value of $V_1$, the forward voltage of the first LED group 102 is reached and current gradually begins to flow through the first LED group 102. At this time, the first depletion MOSFET transistor 126 is in a conducting state such that the current flowing from the rectifier through the first LED group 102 flows through the depletion MOSFET transistor 126 (from drain to source terminals) and the first sense resistor 134.

As the rectified voltage $V_{rect}$ increases in value from $V_1$ to $V_2$, the value of the current flowing through the first LED group 102, the first depletion MOSFET transistor 126, and the first sense resistor 134 increases. The increase in current through the first sense resistor 134 causes the voltage across the first sense resistor 134 to increase, and the corresponding reverse voltage between the gate and source terminals of the first depletion MOSFET transistor 126 to increase. As the reverse gate-source voltage increases, however, the first depletion MOSFET transistor 126 begins to transition out of saturation and into the "linear" or "ohmic" mode or region of operation. The first depiction MOSFET transistor 126 may thus begin to shut down and to conduct less current as the value of the rectified voltage $V_{rect}$ reaches the value $V_2$.

Meanwhile, as the rectified voltage $V_{rect}$ reaches the value $V_2$ (at time $t_2$), the rectified voltage $V_{rect}$ is reaching or exceeding the sum of the forward voltage of the first and second LED groups 102 and 120. As a result, the second LED group 120 begins to conduct current, and the current flowing through the first LED group 102 begins to flow through the series interconnection of the second LED group 120, the second depletion MOSFET transistor 136, and the second and first sense resistors 144 and 134. As $V_{rect}$ exceeds $V_2$ and the first depletion MOSFET transistor 126 enters the cutoff mode, most or all of the current flowing through the first LED group 102 flows through the second LED group 120.

Thus, during the first half of the cycle, no current initially flows through either of the first and second LED groups 102 and 120 and only through the valley fill LED group 110 (period $[t_0, t_1]$). However, as the value of $V_{rect}$ reaches or exceeds $V_1$, current begins to flow through the first LED group 102 which starts to emit light (period $[t_1, t_2]$) while the second LED group 120 remains off. Finally, as the value of $V_{rect}$ reaches or exceeds $V_2$, current begins to flow through both the first and second LED groups 102 and 120 which both emit light (period after $t_2$).

During the second half of the cycle, the rectified voltage $V_{rect}$ decreases from a maximum of $V_{max}$ back to 0 volts. During this period, the second and first LED groups 102 and 120 are sequentially turned off and gradually stop conducting current. In particular, while the value of $V_{rect}$ remains above $V_2$, both the first and second LED groups 102 and 120 remain in the conducting state. However, as the value of $V_{rect}$ reaches or dips below $V_2$ (at time $t_3$), $V_{rect}$ no longer reaches or exceeds the sum of the forward voltage of the first and second LED groups 102 and 120, and the second LED group 120 begins to turn off and to stop conducting current. At around the same time, the voltage drop across the first resistor drops below the threshold voltage of the first depletion MOSFET transistor 126, and the first depletion MOSFET transistor 126 enters the linear or ohmic operation mode and begins to conduct current once again. As a result, current flows through the first LED group 102, the first depletion MOSFET transistor 126, and the first resistor 134, and the first LED group 102 thus continues to emit light.

As the value of $V_{rect}$ reaches or dips below $V_1$ (at time $t_4$), however, $V_{rect}$ no longer reaches or exceeds the forward voltage of the first LED group 102, and the first LED group 102 begins to turn off and stop conducting current. As a result, both the first and second LED groups 102 and 120 turn off and stop emitting light during the period $[t_4, t_5]$. During the period starting at $t_5$ the capacitor 116 discharges causing current to continue to flow to the valley fill LED group 110 above a threshold voltage of the valley fill LED group 110 even as the input voltage to the circuit approaches and reaches zero cross at $t_0$. Therefore, during the period when no input voltage exists and where the input voltage does not reach the threshold voltage of the first LED group 102 light is emitted by the valley fill LED group 110.

FIGS. 2-3 also show a current timing diagram showing the current I as a result of current flowing through the first, second and valley fill LED groups 102, 120 and 110 during one cycle of the rectified voltage $V_{rect}$.

As described in relation to FIG. 2, a current $I_{VF}$ as a result of the discharging of the capacitor 116 flows through the valley fill LED group 110 even when no voltage is provided by the AC input at $t_0$ and during the period $t_0$-$t_1$ when the threshold voltage of the first LED group 102 has not been reached. The current I through the first LED group 102 begins flowing around time $t_1$ once the threshold voltage of the first LED group 102 is reached, and increases to a first value $I_1$. The current I continues to flow through the first LED group 102 from around time $t_1$ to around time $t_4$. Between times $t_2$ and $t_3$, the current I flows through the second LED group 120, and reaches a second value $I_2$. During the time period $[t_2, t_3]$, the current I increases to the value $I_2$. At the time $t_5$ current no longer flows through the first or second LED groups 102 or 120, current continues to flow through the valley fill LED group 110. This current continues to flow from the time $t_5$ of a first cycle to the time $t_1$ of a next cycle.

The $t_5$ to $t_1$ period of time is typically a period when no current is flowing in the circuit and no light is being emitted by the LED groups. As a result, the shape of the current on the represented current timing diagram is referred to as a valley. Hence, the LED group 110 is referred to as the valley fill LED group 110 because the valley fill circuit allows current to flow in the circuit during this $t_5$ to $t_1$ time period filling the valley created on the current timing diagram with a low level of current flow. This results in light being emitted during this period by the valley fill LED group 110, thus providing a constant lighting output through the cycle.

In general, electrical parameters of the components of driving circuit 100 can be selected to adjust the functioning of the circuit 100. For example, the forward voltages of the first and second LED groups 102 and 120 and valley fill LED group 110 may determine the value of the voltages $V_1$, $V_2$ and $V_{VF}$ at which the LED groups are activated. In particular, the voltage $V_1$ may be substantially equal to the forward voltage of the first LED group, while the voltage $V_2$ may be substantially equal to the sum of the forward voltages of the first and second LED groups just as the forward voltage of the valley fill LED group $V_{VF}$ may be substantially equal to the sum of the forward voltages of the valley fill LED group 110.

In one example, the forward voltage of the first LED group 102 may be set to a value of 60V, for example, while the forward voltage of the second LED group may be set to a value of 40V, such that the voltage $V_1$ is approximately equal to 60V and the voltage $V_2$ is approximately equal to 100V. In addition, the value of the first resistor 134 may be set such that the first depletion MOSFET transistor 126 enters a non-conducting state when the voltage $V_{rect}$ reaches a value of $V_2$. As such the value of the first resistor 134 may be set based on the threshold voltage of the first depletion MOSFET transistor 126, the drain-source resistance of the first depletion MOSFET transistor 126, and the voltages $V_1$ and $V_2$. In one example, the first resistor may have a value of around 31.6 ohms.

The conditioning circuitry 100 of FIG. 1 can be used to provide dimmable lighting using the first and second LED groups 102 and 120. The conditioning circuitry can, in particular, provide a variable lighting intensity based on the amplitude of the rectified driving voltage $V_{rect}$.

As shown in FIG. 3, a portion of the driving voltage $V_{rect}$ has been cut. The driving voltage $V_{rect}$ may have been cut or reduced through the activation of a potentiometer, a dimmer switch, or other appropriate means. While the driving voltage is cut, the threshold voltages $V_1$ and $V_2$ remain constant as the threshold voltages are set by parameters of the components of the circuit 100.

Because the driving voltage $V_{rect}$ is cut, the driving voltage takes a time [$t_0$, $t_1$'] to reach the first threshold voltage $V_1$ during the first half of each cycle that is longer than the time [$t_0$, $t_1$]. Similarly, the driving voltage may fail to reach the second threshold voltage. As a result, the time-period [$t_1$', $t_4$'] during which current flows through the first LED group 102 is substantially reduced with respect to the corresponding time-period [$t_1$] when the input voltage is not cut. Because the lighting intensity produced by each of the first and second LED groups 102 and 120 is dependent on the total amount of current flowing through the LED groups, the shortening of the time-periods during which current flows through each of the LED groups causes the lighting intensity produced by each of the LED groups to be reduced.

In addition, one will appreciate that during a process, such as a dimming process in which voltage is reduced the capacitor 116 discharges to provide current that flows through the valley fill LED group 110 such that light is emitted by the valley fill LED group 110 as long as current continues to flow through the circuit 100 via an electrical input. Thus, as an example, when a phase cut dimmer as is represented in FIG. 3 is provided a portion of the input voltage is eliminated and current $I_{VF}$ continues to flow through the valley fill LED group 110. Therefore, during this period of the cycle constant light is emitted by the circuit 100 as long as input current is provided to the circuit 100.

In addition to providing dimmable lighting, the conditioning circuitry 100 of FIG. 1 can be used to provide color-dependent dimmable lighting. In order to provide color-dependent dimmable lighting, the first and second LED groups may include LEDs of different colors, or different combinations of LEDs having different colors. When a full amplitude voltage $V_{rect}$ is provided, the light output of the conditioning circuitry 100 is provided by both the first and second LED groups, and the color of the light output is determined based on the relative light intensity and the respective color light provided by each of the LED groups.

As the amplitude of the voltage $V_{rect}$ is reduced, however, the light intensity provided by the second LED group will be reduced more rapidly than the light intensity provided by the first LED group. As a result, the light output of the conditioning circuitry 100 will gradually be dominated by the light output (and the color of light) produced by the first LED group.

Additionally, the color of the valley fill LED group 110 shall be constant throughout the cycle. Thus depending upon the application, a color or a predetermined range of wavelengths is chosen to cause a biological reaction in a plant or animal that is being illuminated by the light source. In one embodiment the valley fill LED group 110 emits a narrow range of wavelengths in the green band of wavelengths (between 495 nm and 570 nm). In another embodiment the valley fill LED group 110 emits a narrow range of wavelengths in the UV range (below 400 nm). Other narrow ranges can be selected by a user depending on the biological needs of the living organisms that receive the light.

The circuit 100 may have three voltage thresholds $V_1$, $V_2$, and $V_{VF}$ at which different LED groups are activated. In particular, the first LED group 102 has a driving voltage $V_{rect}$ that exceeds the first voltage threshold $V_1$, the second LED group 120 may be activated for a period [$t_2$, $t_3$] (FIG. 2) during which the driving voltage $V_{rect}$ exceeds the second voltage threshold $V_2$, and the valley fill LED group 110 may is activated even during a period [$t_5$, $t_1$] during which the driving voltage $V_{rect}$ exceeds the voltage threshold $V_{VF}$ of the valley fill LED group 110 but does not exceed the voltage threshold $V_1$ or $V_2$ of the first and second LED groups 102 and 120. As voltage decreases during the period [$t_4$-$t_5$] the driving voltage drops below the threshold voltage of the second LED group 120.

As input voltage continues to decrease and drops below the threshold voltage of the valley fill LED group 110, the capacitor 116 ensures the threshold voltage of the valley fill LED group 110 is exceeded within the circuit, even at a time the input voltage approaches and is at zero cross $t_0$. Then this cycle repeats with the threshold voltage of the valley fill LED group 110 continuously exceeded from $t_0$ to $t_0$ as long as an input electrical signal is being supplied to the circuit 100.

While the circuit 100 provided is a two-stage circuit having a first LED group 102, first depletion MOSFET transistor 126 and first sense resistor 134 in a first stage and a second LED group 120, second depletion MOSFET transistor 136 and second sense resistor 144 in a second stage, additional stages can be added to the circuit with additional LED groups, depletion MOSFET transistors and sense resistors as is known in the art. With each additional stage added additional threshold voltages are provided that when exceeded allow current to flow through the additional LED groups identically to the first and second LED groups 102 and 120 as described.

Additionally, while the circuit 100 is described as utilizing depletion MOSFET transistors, other transistors and combinations of transistors can be utilized that provide the same functionality as the MOSFET transistors by holding current constant until threshold voltages of LED groups are met as is known in the art. One will appreciate the ancillary circuitry 107 can be implemented in all such circuits to provide the valley fill functionality described without falling outside the scope of this disclosure.

By having ancillary circuitry 107 with the capacitor 116 provides a charge for the diodes in the valley fill LED group 110 to ensure current is always flowing to the valley fill LED group 110 to provide a low level of light output at all times. Even when dimmed through phase cutting, the valley fill LED group 110 continues to receive current and operate to provide light during operation of the circuit 100. At no time during operation does current cease to flow through the valley fill LED group 110 ensuring no periods of the absence of light exist during operation preventing the detection of such periods and reducing gap between the peak of the sine wave to the valley of the sine wave. Thus flicker and dimming properties are improved. This also allows for increased functionality because the valley fill LED group 110 can have a predetermined color such as green or UV known to enhance the growth of animals or plants while the other LED groups 102 and 120 can have their own predetermined color again to enhance the growth of plants, animals, aquatic life or the like.

Each of the first, second and valley fill LED groups 102, 120 and 110 has a forward voltage (or threshold voltage). The forward voltage generally is a minimum voltage required across the LED group in order for current to flow through the LED group, and/or for light to be emitted by the LED group. The first, second and valley fill LED groups 102, 120 and 110 may have the same forward voltage (e.g., 50 volts), or the first, second and valley fill LED groups 102,

120 and 110 may have different forward voltages (e.g., 60 volts, 50 volts, and 40 volts, respectively). Therefore the gap between peak current and the current at a valley, or minimum current, is reduced to improve dimming properties and provide additional functionality to a lighting device. This is accomplished without utilizing an ancillary transistor, thus reducing cost and minimizing complexities.

The conditioning circuit shown and described in this application, and shown in the figures, and the various modifications to conditioning circuits described in the application, are configured to drive LED lighting circuits with reduced or minimal total harmonic distortion. By using analog circuitry which gradually and selectively routes current to various LED groups, the conditioning circuits provide a high lighting efficiency by driving one, two, or more LED groups based on the instantaneous value of the driving voltage.

Furthermore, by using depletion MOSFET transistors with elevated drain-source resistances $r_{ds}$, the depletion MOSFET transistors transition between the saturation and cutoff modes relatively slowly. As such, by ensuring that the transistors gradually switch between conducting and non-conducting states, the switching on and off of the LED groups and transistors follows substantially sinusoidal contours. As a result, the circuitry produces little harmonic distortion as the LED groups are gradually activated and deactivated.

In addition, the first and second (or more) LED groups control current through each other: the forward voltage level of the second LED group influences the current flow through the first LED group, and the forward voltage level of the first LED group influences the current flow through the second LED group. As a result, the circuitry is self-controlling through the interactions between the multiple LED groups and multiple MOSFET transistors.

In one aspect, the term "field effect transistor (FET)" may refer to any of a variety of multi-terminal transistors generally operating on the principals of controlling an electric field to control the shape and hence the conductivity of a channel of one type of charge carrier in a semiconductor material, including, but not limited to a metal oxide semiconductor field effect transistor (MOSFET), a junction FET (JFET), a metal semiconductor FET (MESFET), a high electron mobility transistor (HEMT), a modulation doped FET (MODFET), an insulated gate bipolar transistor (IGBT), a fast reverse epitaxial diode FET (FREDFET), and an ion-sensitive FET (ISFET).

In one aspect, the terms "base," "emitter," and "collector" may refer to three terminals of a transistor and may refer to a base, an emitter and a collector of a bipolar junction transistor or may refer to a gate, a source, and a drain of a field effect transistor, respectively, and vice versa. In another aspect, the terms "gate," "source," and "drain" may refer to "base," "emitter," and "collector" of a transistor, respectively, and vice versa.

Unless otherwise mentioned, various configurations described in the present disclosure may be implemented on a Silicon, Silicon-Germanium (SiGe), Gallium Arsenide (GaAs), Indium Phosphide (InP) or Indium Gallium Phosphide (InGaP) substrate, or any other suitable substrate.

A reference to an element in the singular is not intended to mean "one and only one" unless specifically so stated, but rather "one or more." For example, a resistor may refer to one or more resistors, a voltage may refer to one or more voltages, a current may refer to one or more currents, and a signal may refer to differential voltage signals.

The word "exemplary" is used herein to mean "serving as an example or illustration." Any aspect or design described herein as "exemplary" is not necessarily to be construed as preferred or advantageous over other aspects or designs. In one aspect, various alternative configurations and operations described herein may be considered to be at least equivalent.

A phrase such as an "example" or an "aspect" does not imply that such example or aspect is essential to the subject technology or that such aspect applies to all configurations of the subject technology. A disclosure relating to an example or an aspect may apply to all configurations, or one or more configurations. An aspect may provide one or more examples. A phrase such as an aspect may refer to one or more aspects and vice versa.

A phrase such as an "embodiment" does not imply that such embodiment is essential to the subject technology or that such embodiment applies to all configurations of the subject technology. A disclosure relating to an embodiment may apply to all embodiments, or one or more embodiments. An embodiment may provide one or more examples. A phrase such as an embodiment may refer to one or more embodiments and vice versa. A phrase such as a "configuration" does not imply that such configuration is essential to the subject technology or that such configuration applies to all configurations of the subject technology.

A disclosure relating to a configuration may apply to all configurations, or one or more configurations. A configuration may provide one or more examples. A phrase such a configuration may refer to one or more configurations and vice versa.

In one aspect of the disclosure, when actions or functions are described as being performed by an item (e.g., muting, lighting, emitting, driving, flowing, generating, activating, turning on or off, selecting, controlling, transmitting, sending, or any other action or function), it is understood that such actions or functions may be performed by the item directly or indirectly. In one aspect, when a module is described as performing an action, the module may be understood to perform the action directly. In one aspect, when a module is described as performing an action, the module may be understood to perform the action indirectly, for example, by facilitating, enabling or causing such an action.

In one aspect, unless otherwise stated, all measurements, values, ratings, positions, magnitudes, sizes, and other specifications that are set forth in this specification, including in the claims that follow, are approximate, not exact. In one aspect, they are intended to have a reasonable range that is consistent with the functions to which they relate and with what is customary in the art to which they pertain.

In one aspect, the term "coupled", "connected", "interconnected", or the like may refer to being directly coupled, connected, or interconnected (e.g., directly electrically coupled, connected, or interconnected). In another aspect, the term "coupled", "connected", "interconnected", or the like may refer to being indirectly coupled, connected, or interconnected (e.g., indirectly electrically coupled, connected, or interconnected).

The disclosure is provided to enable any person skilled in the art to practice the various aspects described herein. The disclosure provides various examples of the subject technology, and the subject technology is not limited to these examples. Various modifications to these aspects will be readily apparent to those skilled in the art, and the generic principles defined herein may be applied to other aspects.

All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112, sixth paragraph, unless the element is expressly recited using the phrase "means for" or, in the case of a method claim, the element is recited using the phrase "step for." Furthermore, to the extent that the term "include," "have," or the like is used, such term is intended to be inclusive in a manner similar to the term "comprise" as "comprise" is interpreted when employed as a transitional word in a claim.

The Title, Background, Summary, Brief Description of the Drawings and Abstract of the disclosure are hereby incorporated into the disclosure and are provided as illustrative examples of the disclosure, not as restrictive descriptions. It is submitted with the understanding that they will not be used to limit the scope or meaning of the claims. In addition, in the Detailed Description, it can be seen that the description provides illustrative examples and the various features are grouped together in various embodiments for the purpose of streamlining the disclosure. This method of disclosure is not to be interpreted as reflecting an intention that the claimed subject matter requires more features than are expressly recited in each claim. Rather, as the following claims reflect, inventive subject matter lies in less than all features of a single disclosed configuration or operation. The following claims are hereby incorporated into the Detailed Description, with each claim standing on its own as a separately claimed subject matter.

The claims are not intended to be limited to the aspects described herein, but is to be accorded the full scope consistent with the language claims and to encompass all legal equivalents. Notwithstanding, none of the claims are intended to embrace subject matter that fails to satisfy the requirement of 35 U.S.C. § 101, 102, or 103, nor should they be interpreted in such a way. Any unintended embracement of such subject matter is hereby disclaimed.

What is claimed is:

1. A circuit comprising:

a first series interconnection of a first light-emitting diode (LED) group, a first transistor, and a first resistor; and a second series interconnection of a second LED group, a second transistor, and a second resistor;

wherein the first series interconnection has a cathode coupled to a drain terminal of the first transistor and a source terminal of the first transistor is coupled to a first terminal of the first resistor wherein voltage across the first resistor provides a biasing voltage for the first transistor;

the second series interconnection is coupled to a drain terminal of the second transistor and a first terminal of the second resistor, wherein voltage across the second resistor provides a biasing voltage for the second transistor; and ancillary circuitry bypassing the first series interconnection and having a capacitor to continuously provide current to the first series interconnection such that the first series interconnection continuously emits light during operation of the circuit;

wherein the capacitor is connected between the drain of the second transistor and a rectifier;

wherein the capacitor is connected between the drain of an ancillary transistor and the rectifier;

wherein the ancillary transistor is coupled to a first terminal of an ancillary resistor to provide a biasing voltage for the ancillary transistor.

2. The circuit according to claim 1, wherein the first series interconnection of the first light-emitting diode group emits a green light output.

3. The circuit according to claim 1, wherein the first and second transistors are depletion MOSFET transistors.

4. The circuit according to claim 1, further comprising a dimmer electrically connected to the first series interconnection and second series interconnection.

5. The circuit of claim 1, wherein the first series interconnection has a first color characteristic and the second series interconnection has a second color characteristic.

6. A circuit comprising:

a first series interconnection of a first light-emitting diode (LED) group, a first transistor, and a first resistor; and a second series interconnection of a second LED group, a second transistor, and a second resistor;

wherein the first series interconnection has a cathode coupled to a drain terminal of the first transistor and a source terminal of the first transistor is coupled to a first terminal of the first resistor wherein voltage across the first resistor provides a biasing voltage for the first transistor;

the second series interconnection is coupled to a drain terminal of the second transistor and a first terminal of the second resistor wherein voltage across the second resistor provides a biasing voltage for the second transistor; and ancillary circuitry bypassing the first series interconnection and having a capacitor to continuously provide current to the first series interconnection such that the first series interconnection continuously emits light during operation of the circuit;

wherein the capacitor is connected between the drain of the second transistor and a rectifier, a dimmer electrically connected to the first series interconnection and second series interconnection;

wherein the dimmer reduces the voltage below a threshold voltage of the second series interconnection to prevent the second series interconnection from emitting light at a time the first series interconnection emits light.

7. The circuit of claim 6, wherein the dimmer is a phase cut dimmer.

8. The circuit of claim 6, wherein the first series interconnection has a first color characteristic and the second series interconnection has a second color characteristic.

* * * * *